US006341690B1

(12) United States Patent
Swiatosz

(10) Patent No.: US 6,341,690 B1
(45) Date of Patent: Jan. 29, 2002

(54) GOLF CLUB BAG AND CLUB APPARATUS

(76) Inventor: Edmund Swiatosz, 335 Lake Seminary Cir., Maitland, FL (US) 32751

( * ) Notice: Subject to any disclaimer, the term of this patent is extended or adjusted under 35 U.S.C. 154(b) by 0 days.

(21) Appl. No.: 09/645,271

(22) Filed: Aug. 25, 2000

(51) Int. Cl.[7] ..... A63B 55/04; A63B 55/06

(52) U.S. Cl. ..... 206/315.6; 206/315.3; 473/287

(58) Field of Search ..... 206/315.3, 315.6, 206/315.2, 315.4, 315.5; 473/287

(56) References Cited

U.S. PATENT DOCUMENTS

| | | | | | |
|---|---|---|---|---|---|
| 2,551,780 | A | | 5/1951 | Wood | |
| 2,938,559 | A | | 5/1960 | Harkrader | |
| 4,340,102 | A | | 7/1982 | Isabel | |
| 4,596,328 | A | | 6/1986 | Solheim | |
| 4,753,344 | A | * | 6/1988 | Antonious | 206/315.6 X |
| RE33,203 | E | | 4/1990 | Reimers | |
| 4,944,396 | A | * | 7/1990 | Larkin | 206/315.6 |
| 5,117,884 | A | * | 6/1992 | Diener et al. | 206/315.4 X |
| 5,125,507 | A | | 6/1992 | Graziano, Jr. | |
| 5,135,107 | A | * | 8/1992 | Ingraham | 206/315.6 |
| 5,213,330 | A | | 5/1993 | Benson | |
| 5,226,533 | A | | 7/1993 | Antonious | |
| 5,383,555 | A | * | 1/1995 | Weinmeier | 206/315.6 |
| 5,458,240 | A | | 10/1995 | Rich et al. | |
| 5,544,743 | A | * | 8/1996 | Hong | 206/315.6 X |
| 5,647,807 | A | * | 7/1997 | Nagamoto | 473/305 |
| 5,868,248 | A | | 2/1999 | Joh | |
| 5,927,490 | A | | 7/1999 | Suk | |
| 5,954,199 | A | | 9/1999 | Stratton | |
| 6,093,112 | A | * | 7/2000 | Peters et al. | 473/291 |
| 6,102,202 | A | * | 8/2000 | Jones | 206/315.6 |
| 6,126,556 | A | * | 10/2000 | Hsieh | 473/256 |
| 6,202,841 | B1 | * | 3/2001 | Kang | 206/315.6 |

* cited by examiner

*Primary Examiner*—Allan N. Shoap
*Assistant Examiner*—Tri M. Mai
(74) *Attorney, Agent, or Firm*—William M. Hobby, III

(57) ABSTRACT

The present invention relates to a golf club bag having a club separating collar having a plurality of openings therein for receiving individual golf clubs therein. The collar has a plurality of color coded areas or zones, each area surrounding a plurality of openings in the collar to identify golf club types to allow the rapid removal and placement of a golf club to and from a predetermined area. Each golf club has color coding thereon, such as on the shaft adjacent the golf club head, to match one of the area colors on the golf bag collar for rapid identification of the golf clubs. The golf club collar can include a self-lubricating polymer TEFLON insert placed in each opening within the collar to prevent damage to the golf club shaft on inserting and removing a golf club from the golf club bag.

10 Claims, 3 Drawing Sheets

GOLF CLUB BAG AND CLUB APPARATUS

BACKGROUND OF THE INVENTION

In the field of golf, it is well-known that golf bags are utilized to carry golf clubs and to keep those golf clubs organized while they are used and transported on the golf course during a round of golf.

Traditionally, golf clubs are carried in golf bags carried about a golf course by either the golfers themselves or by their caddies. Such bags are typically constructed to include an oval or rounded tubular golf club compartment as well as a number of externally disposed pockets or other smaller compartments for carrying golf related items such as golf tees, golf balls, scorecards, and pencils for completing score cards. Depending on the quality and cost of the particular golf bag, the golf club compartment is constructed of a unitary ovoid or circular piece of plastic and includes a club divider on its open end, an encapsulating plastic shell which contains the smaller storage compartments, and a stand which extends outward from a side of the bag to assist in positioning the bag in a standing position while one of the clubs from the bag is in use. Alternatively, the bag is constructed to include a multi-sectional golf club compartment which is divided into a number of lined cavities that extend the length of the golf bag and enable the separate grouping of the golf clubs, and a sewn shell surrounding the club compartment for storing golf accessories, including a golf umbrella, a ball retriever, a rain suit, and even a pair of golfer's shoes.

The present invention is directed towards any golf club bag and club system in which the golf club bag has an open end having a collar having color coding over areas of the collar for the rapid identification of the position to store different types of golf clubs in groups. The golf clubs are then color coded to match the color coding on the golf bag collar. The collar can be of any material normally used on golf bags or, for example, the golf bag collar may have self-lubricating polymer inserts positioned in each opening therein which are color coded and which protect the shaft of the golf club upon insertion and removal of the golf club from the golf club bag.

Prior U.S. patents for golf club bags which include means for sorting the golf clubs stored therein and which utilize golf club separating golf bag collars may be seen in the following patents. The Suk U.S. Pat. No. 5,927,490 is for a club separating golf bag collar which physically separates the golf clubs to help prevent contact between the golf club head. The Isabel U.S. Pat. No. 4,340,102 is for a golf club bag having a head with apertures to accommodate a set of inverted golf clubs. The head portion has various shaped openings therein positioned so that the irons are inhibited from rotational movement and to provide a convenient balance and weight distribution of the golf clubs. The Graziano, Jr. U.S. Pat. No. 5,125,507 is for a golf bag having a mouth-shaped as a truncated triangle so that the golf clubs are presented in an orderly, easily visible array to make the clubs easy to select. The Harkrader U.S. Pat. No. 2,938,559 is a golf holder for golf bags in which a collar is inserted onto a golf bag and connected to individual tubes for holding the shafts of golf clubs. The Solhein U.S. Pat. No. 4,596,328 is a throat structure for a golf club bag.

The following U.S. patents are directed towards golf club bags in which the supporting collars on the top of the golf club bags are separated with different levels for sorting and protecting the clubs. The Antonious U.S. Pat. No. 5,226,533 is a golf club holder insert for a golf bag which has separate compartments on different levels. The Joh U.S. Pat. No. 5,868,248 is a golf club divider assembly for use with a golf club bag having individually adjustable club head covering members. The Reimers U.S. Pat. No. RE 33,203 is a golf club device including an interior divider with full length club storage compartments. The Stratton U.S. Pat. No. 5,954,199 is a golf bag with club separator formed on different levels.

It has also been known in the past to color code golf balls, such as shown in the Benson U.S. Pat. No. 5,213,330 for a golf course, golf balls, and method of play. The Rich et al. U.S. Pat. No. 5,458,240 is for a golf bag with individual club head support pockets for positioning each golf club in its own compartment within the golf club bag. The Wood U.S. Pat. No. 2,551,780 is for a golf bag for holding a plurality of golf clubs in which a series of numerals are placed along the upper surface for identifying the position of the different golf clubs.

The present invention is directed towards a golf club bag and golf clubs which are color coded in such a fashion that different grouping of clubs are maintained in different zones of the golf bag by the golf bag collar to allow the rapid insertion and removal of the golf clubs. The golf clubs can be color coded on the golf club shaft next to the head to match the color coding on the collar of the golf club bag. In addition, the golf club collar can have self-lubricating polymer inserts which are also color coded to assist and prevent damage to the golf club shafts.

SUMMARY OF THE INVENTION

The present invention relates to golf bags for holding golf clubs and to the golf clubs used in playing a game of golf and more particularly to a golf club bag having a club separating collar and to golf clubs color coded for rapid identification of the golf club in the golf club bag. A golf club bag and club system has a golf bag having an open end for holding a plurality of inverted golf clubs along with a plurality of golf clubs for storage in the golf bag. The golf bag has a golf bag collar covering the open end which has a plurality of openings therein with each opening being sized to hold one golf club shaft therethrough. The collar has a plurality of areas or zones surrounding a plurality of the openings therein which are color coded for identification of golf club types to allow the placement of each of the golf clubs in a predetermined area and each golf club has color coding thereon, such as on the shaft adjacent the golf club head, to match one of the colors on the golf bag collar for rapid identification of golf clubs and for ease in removal and replacement of the golf club in the golf club bag. The golf club collar can have a self-lubricating polymer TEFLON insert placed in each opening within the collar for color coding the opening as well as preventing damage to the golf club shaft on inserting and removing a golf club from the golf club bag and due to rotational motion of the shaft relative to the bag during a change in position of the bag or during transit vibration.

BRIEF DESCRIPTION OF THE DRAWINGS

Other objects, features, and advantages of the present invention will be apparent from the written description and the drawings in which.

DESCRIPTION OF THE PREFERRED EMBODIMENT

Figure 1:
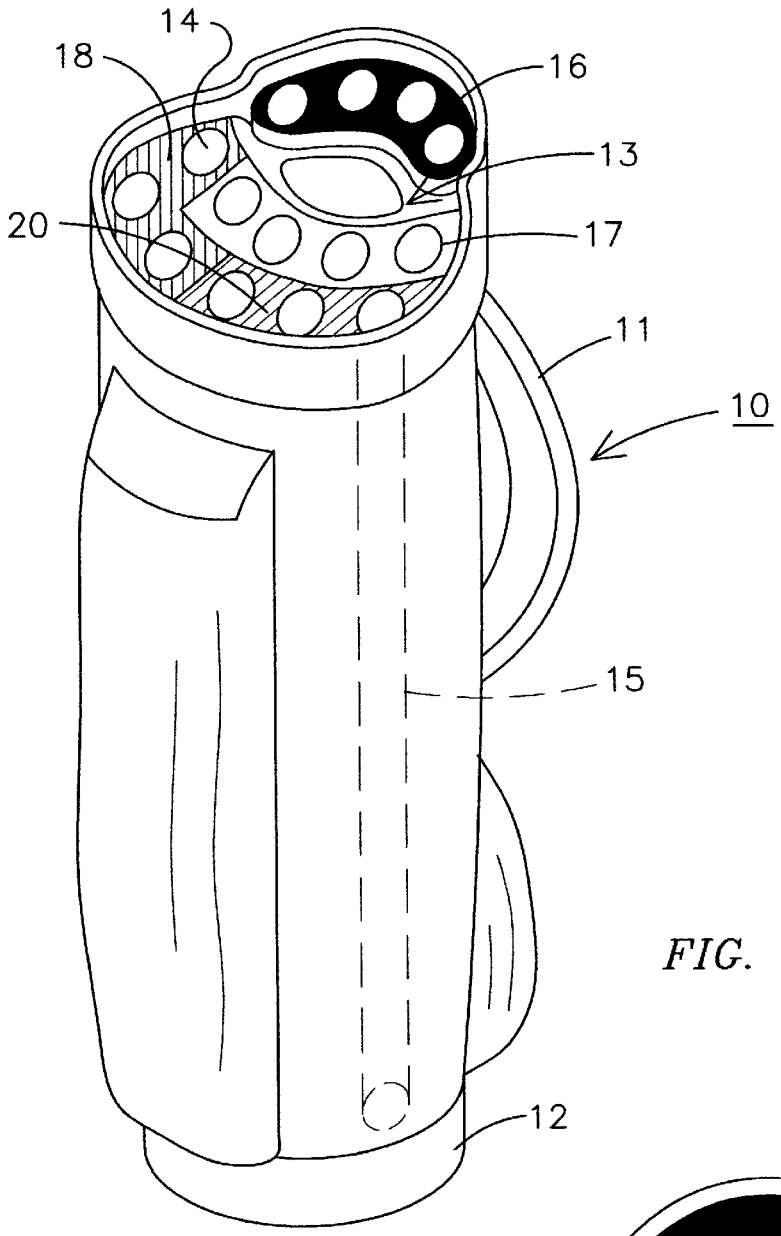
FIG. 1 is a perspective view of a golf club bag having a color coded collar in accordance with the present invention.
Figure 2:
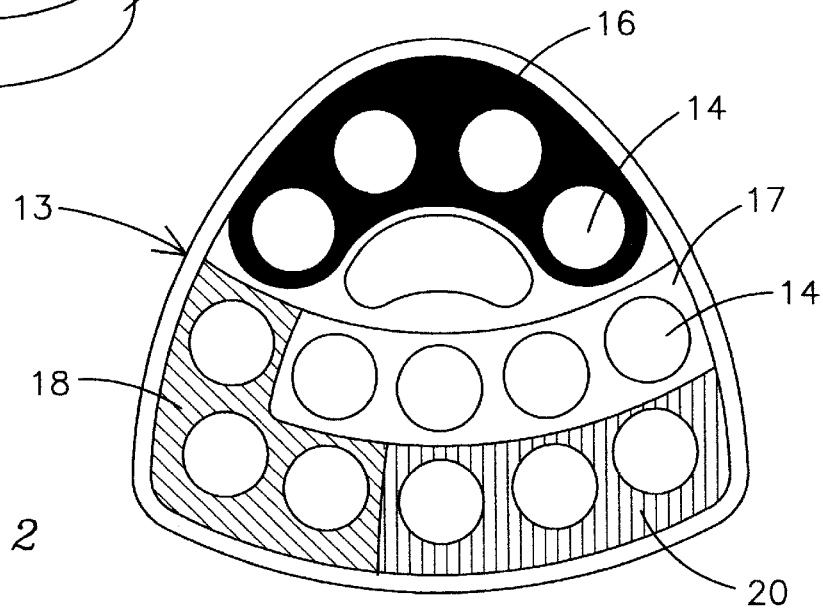
FIG. 2 is a top elevation of the collar of the golf bag of FIG. 1.

Referring to FIGS. 1 and 2 of the drawings, a golf bag 10 has a carrying handle 11 and a base 12. The bag 10 has a golf club supporting collar 13 placed in the top thereof having a plurality of openings 14 through the collar for holding inverted golf clubs having their shafts placed through the openings 14. The golf bag 10 may have a plurality of separate shaft holding tubes 15 connected to each one of the openings 14 for separating the club shafts within the bag 10. The collar 13 has a plurality of color coded areas 16, 17, 18, and 20. In addition, areas, such as 16, may be a raised area from the other areas so that the collar 13 may form multiple tiers. The color codings of the different groupings are selected for identifying certain type of golf clubs which may be rapidly inserted into the correct area as well as quickly located by a golfer for selecting the correct golf club. For instance, the color coded area 16 could contain the woods and could, for instance, be colored a wood or brown color to provide a mnemonic association for the woods while the putter and clubs used in connection with the greens could be the color green.

Figure 3:
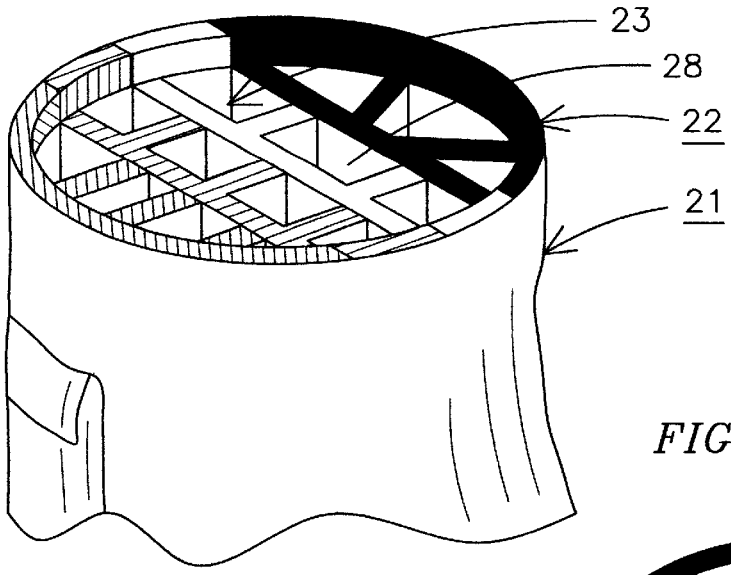
FIG. 3 is a partial perspective view of a golf bag having a second embodiment of a color coded polymer therein.
Figure 4:
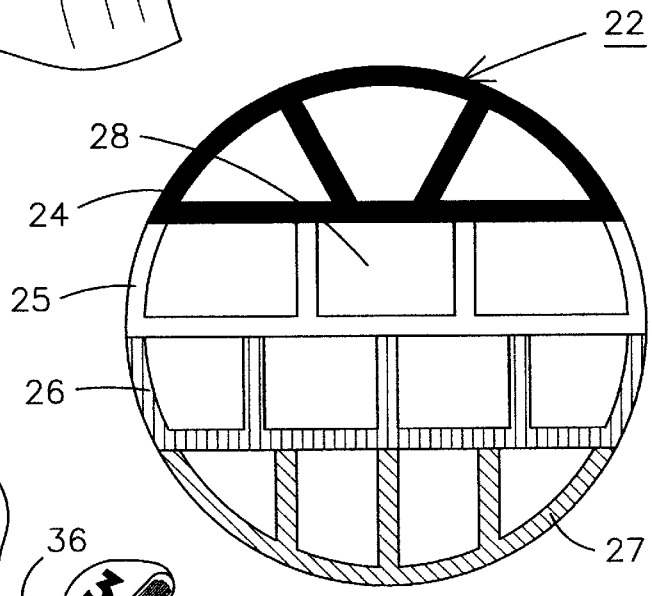
FIG. 4 is a top elevation of the color coded collar of the golf bag of FIG. 3.
Figure 5:
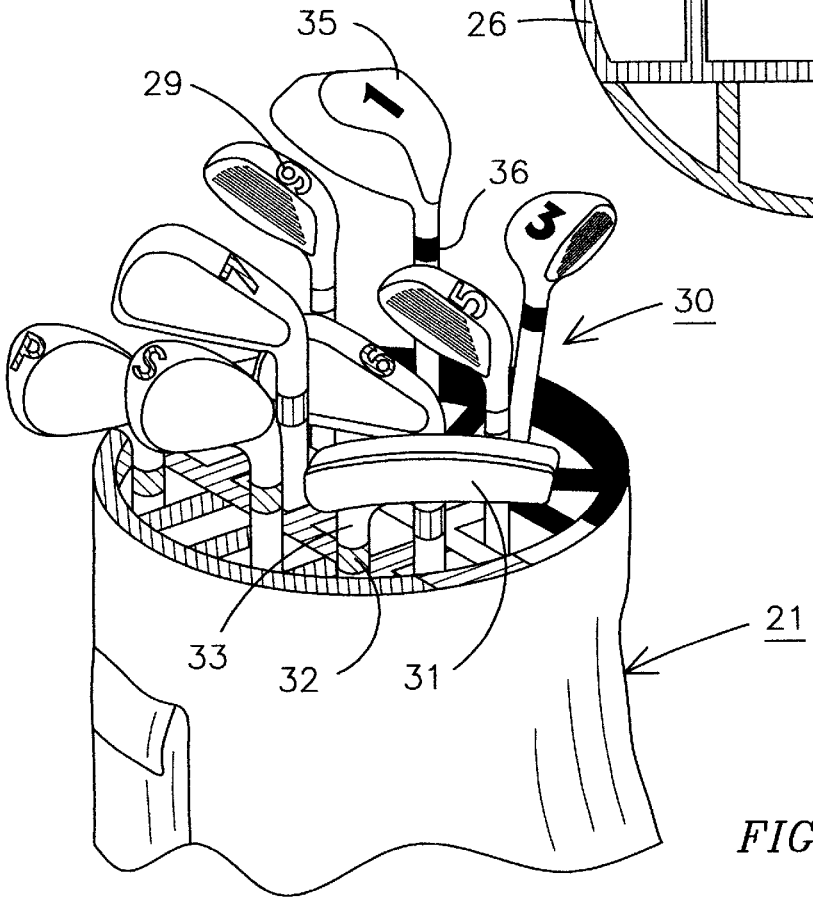
FIG. 5 is a partial perspective of the golf bag of FIG. 3 having color coded golf clubs positioned therein.

Turning to FIGS. 3 through 5, a second golf bag 21 has a collar 22 mounted in the top opening 23 of the golf bag 21. The collar 22 in this case is flat and may have color coded areas 24, 25, 26 and 27. Although the collar 22 in this case is shown flat for descriptive purposes, it can be on a plane at some angle to allow for different size lengths of club shafts. Each color coded area defines a plurality of openings 28 within the collar 22. The collar is mounted to the top of a golf bag 21 and may be made of a self-lubricating polymer, such as TEFLON (POLYTETRAFLUOROETHENE), to prevent scraping and damage to the golf club shafts being placed through the openings 28. The collar may also be a soft felt type of material, such as synthetic fur lining, to prevent scraping damage to graphite type club shafts through the openings 28. A plurality of golf clubs 30 are shown placed in the golf bag 21 through the openings 28 in the collar 22 positioned in their particular color codings. The putter 31 can be seen having a color coded band 32 on the shaft 33 which matches the color code area 27 of the collar 22. The clubs also have color coded numbers 29 thereon for matching the color to the collar 22. Thus, one only needs to match the color code 32 to the color code 27 when inserting the putter 31 into the golf bag. Similarly, a wood 35 has a color band 36 matching the color coded area 24 of the collar 22. Thus, having the collar color coded allows the clubs to be rapidly inserted and removed by merely matching the colors on the individual golf clubs to the color coded area of the collar 22. This also hastens the removal of the clubs from the golf bag 21.

Figure 6:
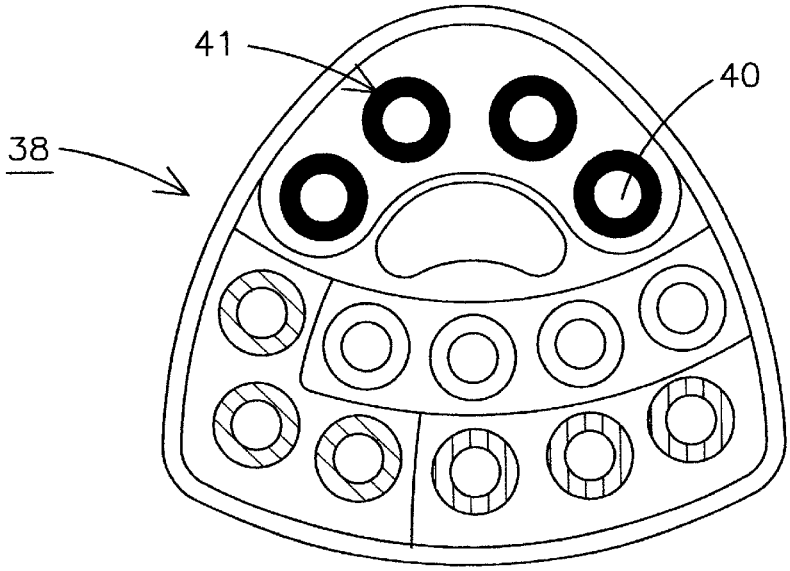
FIG. 6 is an elevation of yet another golf club bag collar having a plurality of color coded inserts in the openings in the collar.
Figure 7:
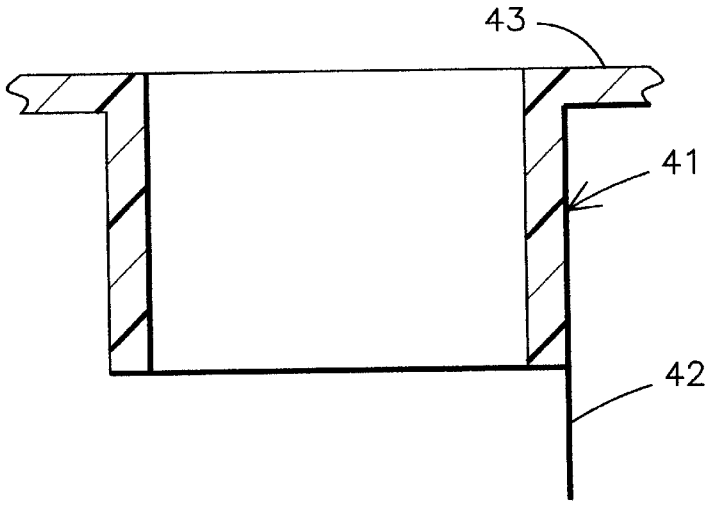
FIG. 7 is a sectional view of an insert of FIG. 6.
Figure 8:
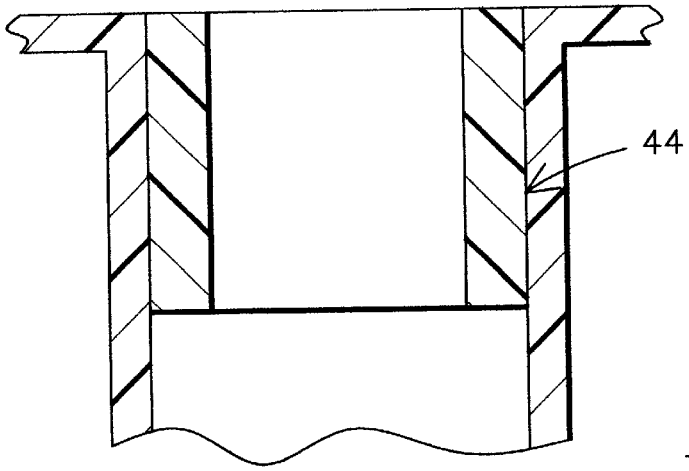
FIG. 8 is a sectional view of a second embodiment of an insert for use in the collar of FIG. 6.

Turning now to FIGS. 6 and 7, an alternate embodiment of a golf club bag collar 38 is illustrated having a plurality of openings 40 therein. Each opening 40 has a color coded grommet or insert 41 protruding therethrough. The inserts 41 may be in assorted colors for color coding the insertion of the individual golf clubs through each opening 40. As seen in FIG. 7, each color coded insert 41 has a generally hollow tube shape 42 having a flanged lip 43 so that it can be inserted into one of the openings 40 of the collar 38. It can be attached to the collar 38 by means of a press fit or, alternatively, can be attached with an adhesive without departing from the spirit and scope of the invention. Each insert 41 is made of a self-lubricating polymer, such as TEFLON, which has been colored throughout the bushing and which allows each golf club to have its shaft inserted through the insert 41 where the self-lubricating insert prevents damage to the golf club shaft while being inserted and removed through the insert. FIG. 8 is a preferred alternate color coded insert using a protective cushion material 44, such as synthetic fur lining, cemented at the top of the tube opening. This is the surface location where all the rubbing contact with the club shaft takes place since the handle end of the shaft is thicker than the shaft near the club head. The cushion material allows each club to have its shaft inserted through insert 44 and prevents damage to the club shaft while being inserted and removed through the insert. This is especially important in connection with graphite shafts on golf clubs which have shown a tendency to wear especially from bag motion and relative twisting of the club shafts during transit vibration in addition to the insertion and removal from golf bags.

It should be clear at this time that a golf club bag having a golf club shaft holding collar attached to the top thereof which is color coded by having different colors in zoned areas of the collar has been provided and which may work with golf clubs which have color coding bands or dots or the like thereon for matching the zoned colored areas of the collar. The collar may be zoned with color coded openings in which each opening holds a plurality of clubs therein. This combination along with the addition of a self-lubricating polymer for the collar or collar portion enhances the insertion and removal of golf clubs from a golf club bag. However, the present invention is not to be construed as limited to the forms shown which are to be considered illustrative rather than restrictive.

I claim:

1. A golf club bag and club system comprising:

a golf bag having an open end for holding a plurality of inverted golf clubs;

a plurality of golf clubs for storage in said golf bag;

a golf bag collar covering said golf bag open end and having a plurality of openings therein, each opening sized to hold at least one golf club shaft therethrough, said collar having a plurality of areas, each area surrounding a plurality of said openings in said golf bag collar and being color coded for identification of a golf club type to thereby allow the placement of each of said plurality of golf clubs in a predetermined area; and each of said golf clubs having color coding thereon to match one of said golf bag collar color code's to thereby allow the rapid identification of golf clubs in a golf club bag and for replacing any removed golf club in a predetermined color coded golf bag collar area.

2. The golf club bag and club system in accordance with claim 1 in which said each golf club has a color marking thereon matching one of said golf bag collar color codes whereby said golf club can rapidly replaced in a predetermined location in said golf bag.

3. The golf club bag and club system in accordance with claim 2 in which said each golf club color marking is on the golf club head.

4. The golf club bag and club system in accordance with claim 3 in which said each golf club color marking is on the shaft of the golf club.

5. The golf club bag and club system in accordance with claim 4 in which said collar has a plurality of levels for further separating said plurality of golf clubs into groups.

6. The golf club bag and club system in accordance with claim 3 in which each golf club has a number identification on the golf club head which is color coded.

7. The golf club bag and club system in accordance with claim 1 in which said collar has a plurality of color coded grommet inserts, each insert being attached through one said collar opening.

8. The golf club bag and club system in accordance with claim 7 in which each color coded grommet insert is made of a self lubricating polymer material.

9. The golf club bag and club system in accordance with claim 8 in which each said color coded grommet insert is made of polytetrafluoroethylene.

10. The golf club bag and club system in accordance with claim 1 in which said golf bag collar is made of a self-lubricating polymer.

* * * * *